United States Patent [19]

Stoltman

[11] 4,421,083

[45] Dec. 20, 1983

[54] ENGINE AIR FLOW REGULATOR

[75] Inventor: Donald D. Stoltman, Henrietta, N.Y.

[73] Assignee: General Motors Corporation, Detroit, Mich.

[21] Appl. No.: 377,387

[22] Filed: May 12, 1982

[51] Int. Cl.[3] ..... F02D 11/10

[52] U.S. Cl. ..... 123/339; 123/585

[58] Field of Search ..... 123/336, 338, 339, 361, 123/585, 586, 587, 589; 261/DIG. 13, DIG. 19, DIG. 56, DIG. 67

[56] References Cited

U.S. PATENT DOCUMENTS

| | | | |
|---|---|---|---|
| 2,860,617 | 11/1958 | Pringham | 123/585 |
| 2,943,615 | 7/1960 | Kainz | 123/585 |
| 3,000,394 | 9/1961 | Gold et al. | 123/585 |
| 3,252,539 | 5/1966 | Ott et al. | 123/585 |
| 3,996,908 | 12/1976 | Brown et al. | 123/585 |
| 4,201,169 | 5/1980 | Michassauridis | 123/339 |
| 4,289,100 | 9/1981 | Kinugawa et al. | 123/585 |
| 4,353,338 | 10/1982 | Wakeman | 123/585 |
| 4,355,606 | 10/1982 | Casey | 123/339 |
| 4,381,747 | 5/1983 | Kobayushi et al. | 123/339 |

*Primary Examiner*—Raymond A. Nelli

*Attorney, Agent, or Firm*—C. K. Veenstra

[57] ABSTRACT

A balanced dual valve member is positioned by a pressure responsive diaphragm and a solenoid reference device to provide an air flow through an engine throttle bypass passage which does not vary with changes in engine manifold pressure.

4 Claims, 2 Drawing Figures

ENGINE AIR FLOW REGULATOR

TECHNICAL FIELD

This invention relates to control of air flow through an engine throttle bypass passage.

BACKGROUND

The principal control of air flow in an automotive spark ignition engine is provided by the throttle in the engine air induction passage. In a substantially closed position the throttle limits the air flow to that required when the engine is idling, and in a wide open position the throttle allows the air flow necessary for maximum speed/maximum load operation. The throttle is positioned so that the engine receives the air flow required for each particular set of engine operating conditions.

In some applications, however, a portion of the engine air flow is directed through a throttle bypass passage so that air flow control can be accomplished independently of throttle position. For example, in some engines air flow through a throttle bypass passage is controlled to establish and maintain a desired engine idle speed.

SUMMARY OF THE INVENTION

This invention provides an improved regulator for controlling air flow through an engine throttle bypass passage.

In this improved regulator, the bypass air flow is divided into two parallel streams or portions for control by a dual valve member. This construction balances the forces exerted on the valve member by the pressure drop across the valve member and allows the valve member to be positioned with a minimum of external force.

Moreover, in this improved regulator one portion of the air flow is directed through a restriction into an intermediate pressure zone upstream of the valve member. A reference device exerts an opening bias on the valve member, while a diaphragm responsive to the pressure in the intermediate pressure zone exerts a closing force on the valve member. The reference device and the diaphragm position the valve member to maintain that zone at a constant pressure determined by the bias of the reference device. The valve member is thus positioned to provide a correspondingly constant air flow through the bypass passage—an air flow which is independent of variations in pressure in the induction manifold downstream of the valve member. A change in the bias of the reference device will establish a different pressure in the intermediate pressure zone and adjust the bypass air flow to correspond to that pressure.

This improved regualtor is particularly suitable for applications involving electronic control of the bypass air flow. A solenoid energized by an electronic control unit may be employed to exert the reference bias, and this improved regulator will maintain the intermediate pressure zone at the pressure determined by the solenoid bias to thereby provide the corresponding bypass air flow.

The details of the preferred embodiment as well as other features and advantages of this invention are set forth in the remainder of the specification and are shown in the accompanying drawing.

THE PREFERRED EMBODIMENT

Figure 1:
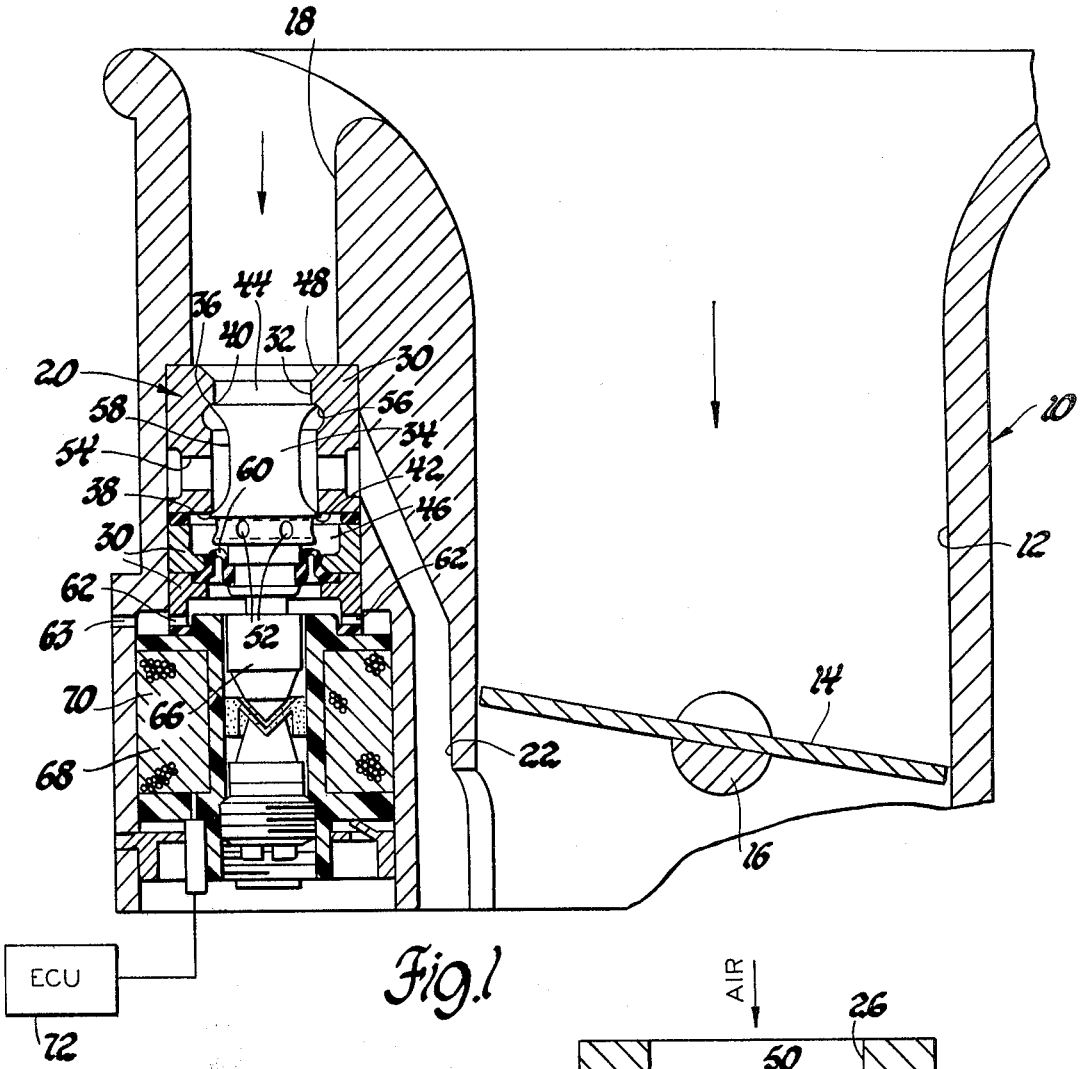
FIG. 1 is a sectional view of an air flow regulator according to this invention which is integrated in an engine throttle body, the regulator valve being shown in its closed position.

Referring first to FIG. 1, a throttle body 10 provides an inlet 12 for an engine air induction passage or manifold. A throttle 14 is mounted on a shaft 16 to control air flow through inlet 12. Throttle 14 is rotated counterclockwise to the position shown when the engine is idling and is rotated clockwise from the position shown to provide open throttle engine operation.

A throttle bypass passage has an inlet 18 which opens from induction passage inlet 12 upstream of throttle 14 and leads through an air flow regulator 20 to an outlet 22 which opens to the induction passage downstream of throttle 14. Regulator 20 controls air flow through throttle bypass passage 18, 22.

Figure 2:
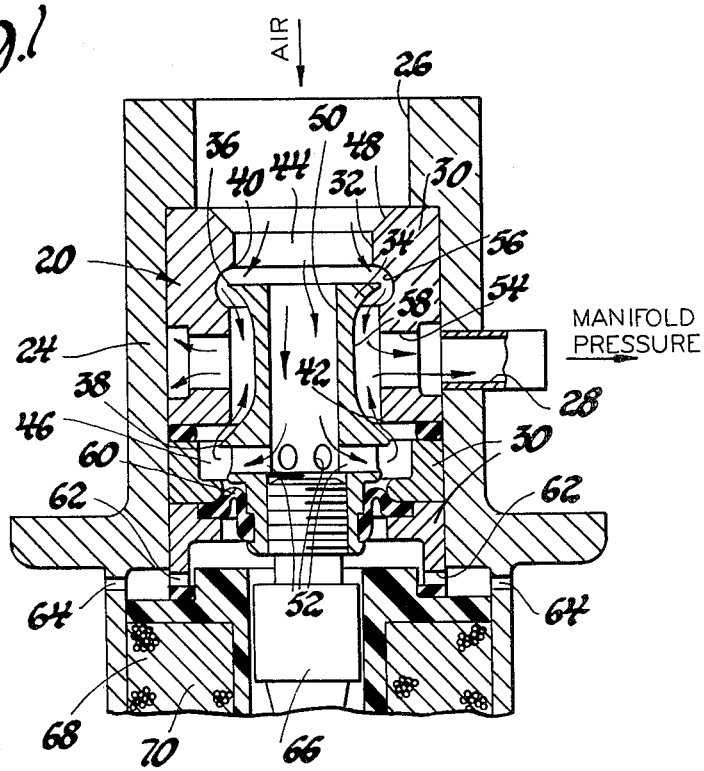
FIG. 2 is an enlarged sectional view of an air flow regulator according to this invention which is mounted in a housing separate from the engine throttle body, the regulator valve being shown in an open position.

As shown in FIG. 2, air flow regulator 20 also may be mounted in a housing 24 which defines a throttle bypass passage having an inlet 26 which leads through regulator 20 to an outlet 28. Inlet 26 is adapted to receive air from an engine air induction passage above the throttle and outlet 28 is adapted to discharge air to an engine air induction passage below the throttle. The air flow regulator of FIG. 2 is identical in all important respects to the air flow regulator of FIG. 1, and the same reference numerals are applied to the two regulators.

Air flow regulator 20 includes a segmented valve body 30 having an axial bore 32. A valve member 34 is disposed in bore 32. Valve member 34 has a pair of valve surfaces 36 and 38 which are respectively associated with valve seats 40 and 42 formed in bore 32. Valve surfaces 36 and 38 and valve seats 40 and 42 divide bore 32 to define an inlet pressure region 44 at one end of valve body 30 and an intermediate pressure region 46 at the other end of valve body 30.

Inlet pressure region 44 has an open or unrestricted inlet connection 48 to inlets 18 and 26. Valve member 34 has an axial bore 50 and a plurality of radial apertures 52 which define a restricted inlet connection from inlets 18 and 26 through inlet pressure region 44 to intermediate pressure region 46. Valve body 30 has an outlet connection 54 opening to outlets 22 and 28. Air flow through throttle bypass passages 18, 22 and 26, 28 is thus divided, with a portion flowing between valve surface 36 and valve seat 40 and through a recess 56 in bore 32 and a recess 58 about valve member 34 to outlet connection 54, and with the remainder flowing through bore 50 and apertures 52 in valve member 34, through intermediate pressure region 46, between valve surface 38 and valve seat 42, and through recess 58 in valve member 34 to outlet connection 54.

A diaphragm 60 is secured to valve member 34 and closes the end of intermediate pressure region 46. One side of diaphragm 60 is thus subjected to the subatmospheric pressure in intermediate pressure region 46, while the other side of diaphragm 60 is subjected to atmospheric pressure through holes 62 in valve body 30 and holes 63 in throttle body 10 or holes 64 in housing 24.

Valve member 34 is also connected to the armature 66 of a solenoid 68. The coil 70 of solenoid 68 is energized by an electronic control unit (ECU) 72 according to a duty cycle which may be varied to establish a desired effective current through coil 70. The duty cycle provided by ECU 72 causes solenoid 68 to exert a bias on valve member 34 tending to increase air flow past valve seats 40 and 42.

During operation, air flow through throttle bypass passages 18, 22 and 26, 28 creates a subatmospheric pressure in intermediate pressure region 46. Diaphragm 60 responds to the reduction in pressure in region 46 and exerts a force on valve member 34 tending to reduce air flow past valve seats 40 and 42. The force exerted by diaphragm 60 opposes the bias exerted by solenoid 68. When the solenoid bias exceeds the diaphragm force, valve surfaces 36 and 38 are displaced from valve seats 40 and 42 to increase air flow through the bypass passage. When the diaphragm force exceeds the solenoid bias, valve surfaces 36 and 38 are displaced toward valve seats 40 and 42 to reduce air flow through the bypass passage. Valve member 34 is thereby positioned to create a pressure in region 46 which balances the diaphragm force with the solenoid bias.

Upon an increase in the duty cycle provided by ECU 72, solenoid 68 causes valve member 34 to increase air flow past valve seats 40 and 42 until the pressure in region 46 drops to a level which again balances the force of diaphragm 60 with the bias of solenoid 68. Upon a decrease in the duty cycle provided by ECU 72, diaphragm 60 causes valve member 34 to reduce air flow past valve seats 40 and 42 until the pressure in region 46 rises to a level which again balances the force of diaphragm 60 with the bias of solenoid 68. Solenoid 68 accordingly comprises a reference device the bias of which determines the subatmospheric pressure to be created in intermediate pressure region 46. It will be appreciated, of course, that the bias of solenoid 68 may be supplemented or opposed by a spring also biasing valve member 34 to increase or reduce air flow past valve seats 40 and 42.

It will be recalled that fluid flow through a restriction in a passage is measured by the area of the restriction and the pressure drop across the restriction. Accordingly, air flow from the atmospheric pressure of inlet pressure region 44 through the fixed restriction of bore 50 and apertures 52 into intermediate pressure region 46 varies inversely with and is determined by the pressure in region 46. Since that same air then flows from intermediate pressure region 46 past valve seat 42 to the subatmospheric manifold pressure of outlet connection 54, it is evident that valve member 34 is positioned so that air flow through intermediate pressure region 46 is independent of variations in manifold pressure. Upon an increase in manifold pressure which reduces the pressure drop across valve seat 42, valve member 34 is displaced to provide an offsetting increase in the flow area between valve surface 38 and valve seat 42. Upon a decrease in manifold pressure which increases the pressure drop across valve seat 42, valve member 34 is displaced to provide an offsetting decrease in the flow area between valve surface 38 and valve seat 42. Thus diaphragm 60 and solenoid 68 position valve member 34 to maintain the air flow past valve seat 42 independent of variations in manifold pressure.

It will be appreciated that valve member 34 similarly maintains the air flow past valve seat 40 independent of variations of manifold pressure. Upon an increase in manifold pressure which reduces the pressure drop across valve seat 40, valve member 34 is displaced as described above to provide an offsetting increase in the flow area between valve surface 36 and valve seat 40. Upon a decrease in manifold pressure which increases the pressure drop across valve seat 40, valve member 34 is displaced as described above to provide an offsetting decrease in the flow area between valve surface 36 and valve seat 40.

It will be noted, however, that air flow past valve seat 40 is not restricted prior to valve seat 40. This permits a higher proportion of the air flow controlled by valve member 34 to flow past valve seat 40 than past valve seat 42. Accordingly, the air flow capacity of regulator 20 is higher than would be possible in the same size unit if air flow to both valve seats 40 and 42 were restricted.

It also will be noted that the pressure drop across valve surface 36 loads valve member 34 with a tendency to increase air flow while the pressure drop across valve surface 38 loads valve member 34 with a tendency to reduce air flow. Because the diameter of valve surface 38 is greater than the diameter of valve surface 36, the larger area of valve surface 38 creates a slight net load tending to reduce air flow. However, the dual valve construction of valve member 34 balances out most of the forces exerted on valve member 34 by the pressure drops across valve surfaces 36 and 38 so that diaphragm 60 and solenoid 68 do not require power to overcome manifold pressure induced forces.

The embodiments of the invention in which an exclusive property or privilege is claimed are defined as follows:

1. An air flow regulator for an engine having an air induction passage containing a throttle, said regulator comprising a valve body having a bore and a valve member disposed in said bore, said valve body having a pair of axially spaced concentric valve seats formed on said bore, said valve member having a pair of valve surfaces each associated with one of said valve seats, said valve seats and valve surfaces dividing said bore to define an inlet pressure region at one end of said bore and an intermediate pressure region at the other end of said bore, said regulator having an open inlet connection to said inlet pressure region and a restricted inlet connection to said intermediate pressure region, said inlet connections being adapted to receive air from said induction passage upstream of said throttle, said regulator having an outlet connection from said bore between said valve seats adapted to discharge air to said induction passage downstream of said throttle, whereby air may flow from said induction passage upstream of said throttle through said inlet connections and said regions, past said valve seats and through said outlet connection to said induction passage downstream of said throttle, a reference device exerting a bias on said valve member tending to increase such air flow, and a diaphragm responsive to the pressure in said intermediate pressure region and exerting a force on said valve member tending to reduce such air flow, said reference device and said diaphragm positioning said valve member to create a pressure in said intermediate pressure region which balances the force exerted by said diaphragm with the bias exerted by said reference device, whereby said valve member is positioned to provide the desired air flow past said valve seats.

2. An air flow regulator for an engine having an air induction passage containing a throttle, said regulator comprising a valve body having a bore and a valve member disposed in said bore, said valve body having a pair of axially spaced concentric valve seats formed on said bore, said valve member having a pair of valve surfaces each associated with one of said valve seats, said valve seats and valve surfaces dividing said bore to define an inlet pressure region at one end of said bore and an intermediate pressure region at the other end of said bore, said regulator having an open inlet connection to said inlet pressure region and a restricted inlet connection to said intermediate pressure region, said inlet connections being adapted to receive air from said induction passage upstream of said throttle, said regulator having an outlet connection from said bore between said valve seats adapted to discharge air to said induction passage downstream of said throttle, whereby air may flow from said induction passage upstream of said throttle through said inlet connections and said regions, past said valve seats and through said outlet connection to said induction passage downstream of said throttle, a solenoid exerting a bias on said valve member tending to increase such air flow, and a diaphragm responsive to the pressure in said intermediate pressure region and exerting a force on said valve member tending to reduce such air flow, said solenoid and said diaphragm positioning said valve member to create a pressure in said intermediate pressure region which balances the force exerted by said diaphragm with the bias exerted by said solenoid, whereby said valve member is positioned to provide the desired air flow past said valve seats.

3. An air flow regulator for an engine having an air induction passage containing a throttle, said regulator comprising a valve body having a bore and a valve member disposed in said bore, said valve body having a pair of axially spaced concentric valve seats formed on said bore, said valve member having a pair of valve surfaces each associated with one of said valve seats, said valve seats and valve surfaces dividing said bore to define an inlet pressure region at one end of said bore and an intermediate pressure region at the other end of said bore, said inlet pressure region being adapted to receive air from said induction passage upstream of said throttle, said valve member having a restricted passage connecting said inlet pressure region and said intermediate pressure region, said regulator having an outlet connection from said bore between said valve seats adapted to discharge air to said induction passage downstream of said throttle, whereby air may flow from said induction passage upstream of said throttle through said inlet pressure region with a portion of such air flow being directed through said restricted passage and said intermediate pressure region, past one of said valve seats and through said outlet connection to said induction passage downstream of said throttle and with the remainder of such air flow being directed past the other of said valve seats and through said outlet connection to said induction passage downstream of said throttle, a reference device exerting a bias on said valve member tending to increase such air flow, and a diaphragm responsive to the pressure in said intermediate pressure region and exerting a force on said valve member tending to reduce such air flow, said reference device and said diaphragm positioning said valve member to create a pressure in said intermediate pressure region which balances the force exerted by said diaphragm with the bias exerted by said reference device, whereby said valve member is positioned to provide the desired air flow past said valve seats.

4. An air flow regulator for an engine having an air induction passage containing a throttle, said regulator comprising a valve body having a bore and a valve member disposed in said bore, said valve body having a pair of axially spaced concentric valve seats formed on said bore, said valve member having a pair of valve surfaces each associated with one of said valve seats, said valve seats and valve surfaces dividing said bore to define an inlet pressure region at one end of said bore and an intermediate pressure region at the other end of said bore, said inlet pressure region being adapted to receive air from said induction passage upstream of said throttle, said valve member having a restricted passage connecting said inlet pressure region and said intermediate pressure region, said regulator having an outlet connection from said bore between said valve seats adapted to discharge air to said induction passage downstream of said throttle, said valve member having a peripheral recess providing a flow connection between one of said valve seats and said outlet connection, said bore having a peripheral recess providing a flow connection between the other of said valve seats and said valve member recess and thus between said other valve seat and said outlet connection, whereby air may flow from said induction passage upstream of said throttle through said inlet pressure region with a portion of such air flow being directed through said restricted passage and said intermediate pressure region, past said one valve seat and through said valve member recess and said outlet connection to said induction passage downstream of said throttle and with the remainder of such air flow being directed past said other valve seat and through said recesses and said outlet connection to said induction passage downstream of said throttle, a solenoid exerting a bias on said valve member tending to increase such air flow, and a diaphragm responsive to the pressure in said intermediate pressure region and exerting a force on said valve member tending to reduce such air flow, said solenoid and said diaphragm positioning said valve member to create a pressure in said intermediate pressure region which balances the force exerted by said diaphragm with the bias exerted by said solenoid, whereby said valve member is positioned to provide the desired air flow past said valve seats, and wherein the difference in pressure on the valve surface associated with said one valve seat loads said valve member with a tendency to reduce flow past said valve seats, the difference in pressure on the other of said valve surfaces loads said valve member with a tendency to increase flow past said valve seats, and the area of said one valve surface is larger than the area of said other valve surface by an amount sufficient to provide a slight net load on said valve member tending to reduce flow past said valve seats.

* * * * *